United States Patent [19]

Dickson

[11] 4,373,682

[45] Feb. 15, 1983

[54] HOLDER FOR TOILET PAPER ROLL

[76] Inventor: Robert A. Dickson, 33A Knowles Ave., Daly City, Calif. 94014

[21] Appl. No.: 188,421

[22] Filed: Sep. 18, 1980

[51] Int. Cl.[3] ..... B65H 19/00

[52] U.S. Cl. ..... 242/55.2; 242/55.42

[58] Field of Search ..... 242/55.2, 55.42, 55.53; 211/16; 225/46, 51; 312/37

[56] References Cited

U.S. PATENT DOCUMENTS

| | | | |
|---|---|---|---|
| 2,073,429 | 3/1937 | Spicher | 242/55.2 |
| 2,390,399 | 12/1945 | Tator et al. | 242/55.53 |
| 2,419,798 | 4/1947 | Stone | 242/55.2 |
| 2,562,923 | 8/1951 | Kolivoski | 242/55.2 |
| 3,145,940 | 8/1964 | Henry | 242/55.2 |
| 3,788,573 | 1/1974 | Thomson et al. | 242/55.2 |
| 3,892,368 | 7/1975 | Ricards | 242/55.2 |
| 4,102,510 | 7/1978 | Anderson | 242/55.2 |

FOREIGN PATENT DOCUMENTS

| | | | |
|---|---|---|---|
| 55-93750 | 7/1980 | Japan | 242/55.2 |

*Primary Examiner*—Leonard D. Christian

[57] ABSTRACT

A holder for a toilet paper roll in which the holder includes a spindle on a bracket with the spindle having resilient material thereon for frictionally engaging the central cardboard tube of the toilet paper roll. In one embodiment, the spindle is rigid to the bracket and has a slot therethrough extending longitudinally of the spindle. The resilient material is press-fitted in the slot and projects laterally from the spindle in opposed directions. In another embodiment, the spindle is L-shaped and has an outer end on which the spindle is mounted. The spindle can either be rigid to the outer end of the bracket or rotatably mounted thereon. A cover can be removably mounted on the bracket and the cover has a slot for allowing the paper from the toilet paper roll to pass through the cover. In another embodiment, the bracket and spindle can be mounted on the inner surface of a swingable door or gavel having a paper-receiving slot. The resilient material on the spindle can be bottle brush material having bristles for frictionally engaging the central cardboard tube of a toilet paper roll. In a further embodiment, the spindle can be motor driven by a motor mounted in a housing adjacent to the bracket.

This invention relates to improvements in the mounting of toilet paper rolls and, more particularly, to an improved holder for a toilet paper roll.

14 Claims, 10 Drawing Figures

HOLDER FOR TOILET PAPER ROLL

BACKGROUND OF THE INVENTION

There have been numerous devices designed and developed to hold a conventional toilet paper roll and, for the most part, these devices have been generally satisfactory although relatively expensive or complex in construction. Such devices include spindles which are smaller in size than the inner diameter of the cardboard tube at the center of a toilet paper roll. This allows the tube of a toilet paper roll to rotate freely on such a spindle but requires a considerable degree of manual dexterity to replace a depleted roll with a new roll. Because of the relative complexity of such devices and the necessity for disassembly of the holder to replace rolls, a need has arisen for an improved holder for a toilet paper roll so as to provide a holder which is simple and rugged in construction, is relatively inexpensive, and releasably holds a toilet paper roll in a manner which permits rapid replacement of the roll without difficulty.

SUMMARY OF THE INVENTION

The present invention satisfies the aforesaid need by providing an improved holder for a toilet paper roll in which the spindle of the holder has resilient material thereon for frictionally engaging the inner surface of the central cardboard tube of the toilet paper roll. In this way, the roll can be easily gripped and releasably held in an operative position even though the central tube is horizontally or vertically disposed. Moreover, such a holder can be made at a relatively modest cost and with commercially available materials, yet the holder can be attractive in appearance and requires substantially no disassembly to substitute one toilet paper roll for another.

The primary object of the present invention is to provide an improved holder for a toilet paper roll wherein the holder includes a spindle having resilient material thereon for frictionally and releasably engaging the inner surface of the cardboard tube at the center of such a roll so that the holder is simple and rugged in construction, can be made of relatively few parts and is relatively inexpensive yet the holder provides a positive attachment to such a toilet paper roll.

Another object of the present invention is to provide a holder of the type described wherein the roll can be easily placed on and taken off the spindle with substantially no disassembly of the holder so as to simplify replacement of the roll.

Other objects of this invention will become apparent as the following specification progresses, reference being had to the accompanying drawings for several embodiments of the invention.

IN THE DRAWINGS

Figure 1:
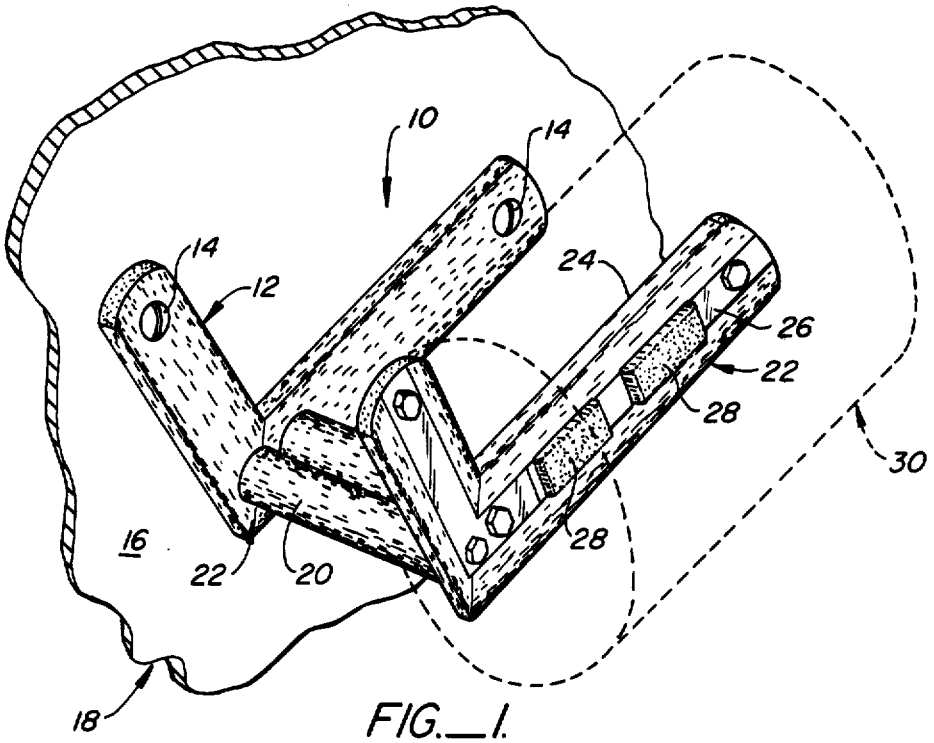
FIG. 1 is a perspective view of a first embodiment of the holder of the present invention, showing a toilet paper roll in dashed lines.

The first embodiment of the holder for a toilet paper roll is shown in FIG. 1 and is denoted by the numeral 10. Holder 10 comprises an L-shaped bracket 12 having a pair of holes at the ends thereof for receiving screws 14 for attaching the bracket to the flat surface 16 of a wall or other vertical support 18.

Bracket 12 has a rigid extension 20 extending outwardly therefrom near location 22 thereof. A second, L-shaped bracket 22 substantially similar in shape to bracket 12 is secured to the outer end of extension 20. Bracket 22 has a leg 24 defining a cantilevered spindle provided with an elongated slot 26 therethrough. The slot has one or more pieces 28 of resilient material which are press-fitted in and extend through the slot and outwardly therefrom on opposed sides thereof. The transverse width of pieces 28 which extend through slot 26 is great enough so that the outer surface portions of pieces 28 will frictionally engage the inner surface of the central cardboard tube of a conventional roll 30 of toilet paper placed on the cantilevered leg 24. The frictional force caused by pieces 28 assures that the roll 30 will be releasably held on bracket 22 yet the roll can rotate on leg 24 when the paper is pulled off the roll. The cantilever nature of leg 24 permits immediate replacement of a depleted roll because the central tube of a depleted roll can merely be pulled off leg 24 and a new roll can be placed thereon immediately thereafter.

FIG. 1 shows leg 24 at an inclined angle with respect to the horizontal. However, leg 24 could be horizontal or vertical if desired. The material of pieces 28 typically is of a plastic sponge material but it can be of other materials, such as sponge rubber. Pieces 28 can be manually squeezed into slot 26 and held therein by friction against the adjacent sides of leg 24 defining the boundaries of slot 26. Also, the distance between leg 24 and bracket 12 is at least slightly greater than half the diameter of roll 30 so that the roll can rotate on leg 40 notwithstanding the light frictional force applied to the inner surface of the central tube of roll 30 by pieces 28.

Figure 2:
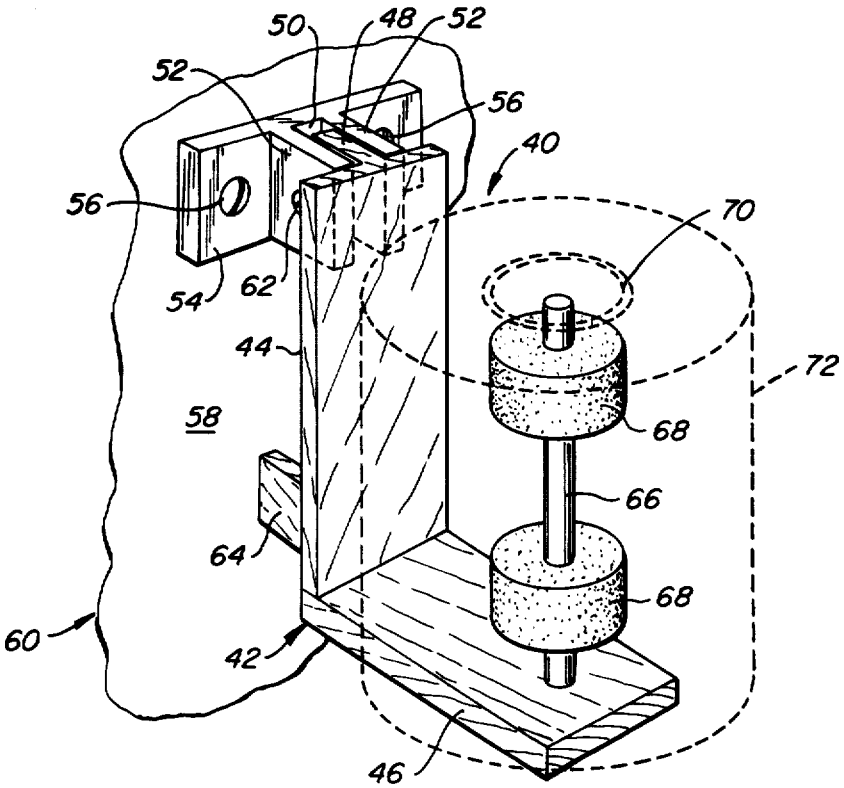
FIG. 2 is a perspective view of a second embodiment of the holder of the present invention.

The second embodiment of the holder of the present invention is broadly denoted by the numeral 40 and includes an L-shaped bracket 42 having a first leg 44 and a second leg 46 connected to leg 44 at one end thereof. The opposite end of leg 44 is provided with an ear 48 which is received within a slot 50 defined by a pair of spaced lugs 52 mounted on a base 54 which is secured by screws 56 to the flat surface 58 of a wall 60 or the like. Ear 48 is hingedly mounted to lugs 52 by a pin 62 and lugs 52 frictionally engage extension 48 so that bracket 42 can either be held in the position shown in FIG. 2 or the position shown in FIG. 3. In the FIG. 2 position, leg 44 has a spacer 64 which engages surface 58 to maintain leg 44 in a substantially vertical position. In this case, leg 46 is substantially horizontal and a cantilevered spindle 66 on leg 46 is in a generally vertical position, the spindle having one or more pieces 68 of resilient material for frictionally engaging the inner surface of the central cardboard tube 70 of a roll 72 of toilet paper. The material of pieces 68 can be plastic sponge material, sponge rubber or other resilient material. Pieces 68 are generally cylindrical in shape and only apply a light frictional force to tube 70 if spindle 66 is rigid to leg 46 so that roll 72 can rotate on spindle 66 to allow paper to be unrolled from the roll. In the alternative, spindle 66 could be rotatably mounted on leg 46 and the frictional force between pieces 68 and tube 70 could be greater.

Figure 3:
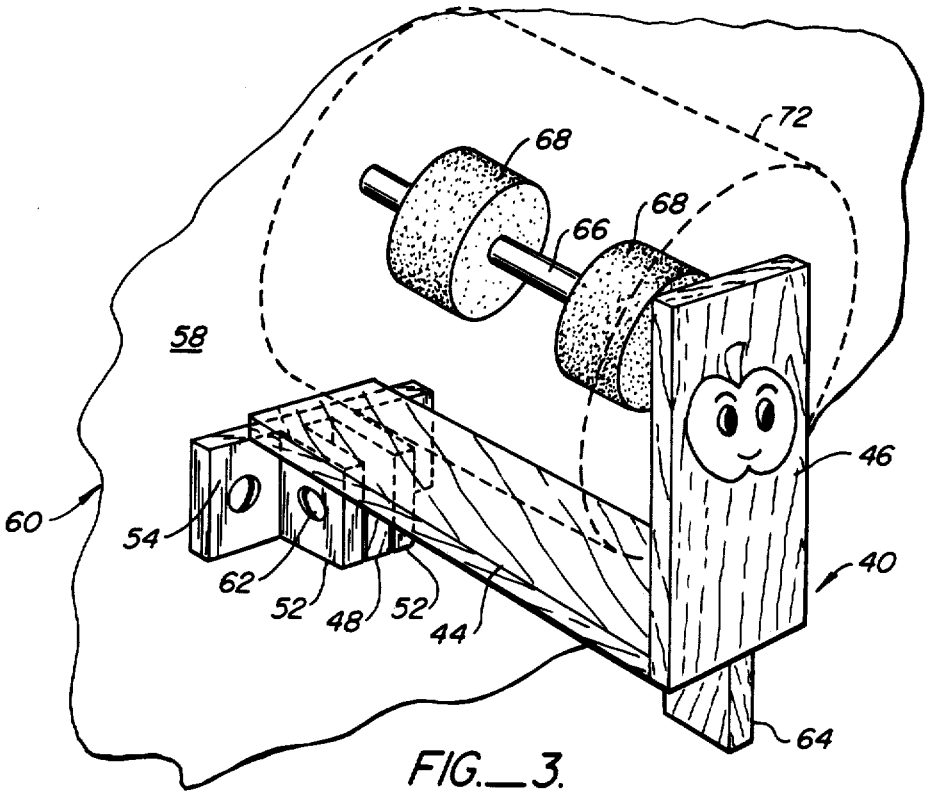
FIG. 3 is a perspective view of the embodiment of the holder of FIG. 2 but showing the way in which it is positioned at right angles to the position shown in FIG. 2.

In the position of FIG. 3, holder 40 has leg 44 generally horizontal and leg 46 generally vertical. Spindle 66 is generally horizontal above leg 44 and roll 72 is in a generally horizontal position. The length of leg 44 is such that roll 72 does not engage surface 58 of wall 60. The frictional engagement between extension 48 and lugs 52 keeps leg 44 substantially horizontal although it can be forced downwardly into the position of FIG. 2 if desired. To replace roll 72 in FIG. 2, bracket 42 is swung to the position of FIG. 2 and the depleted roll is lifted from the spindle and a new roll is forced onto the spindle. Then the bracket is swung back to the FIG. 3 position.

Figure 4:
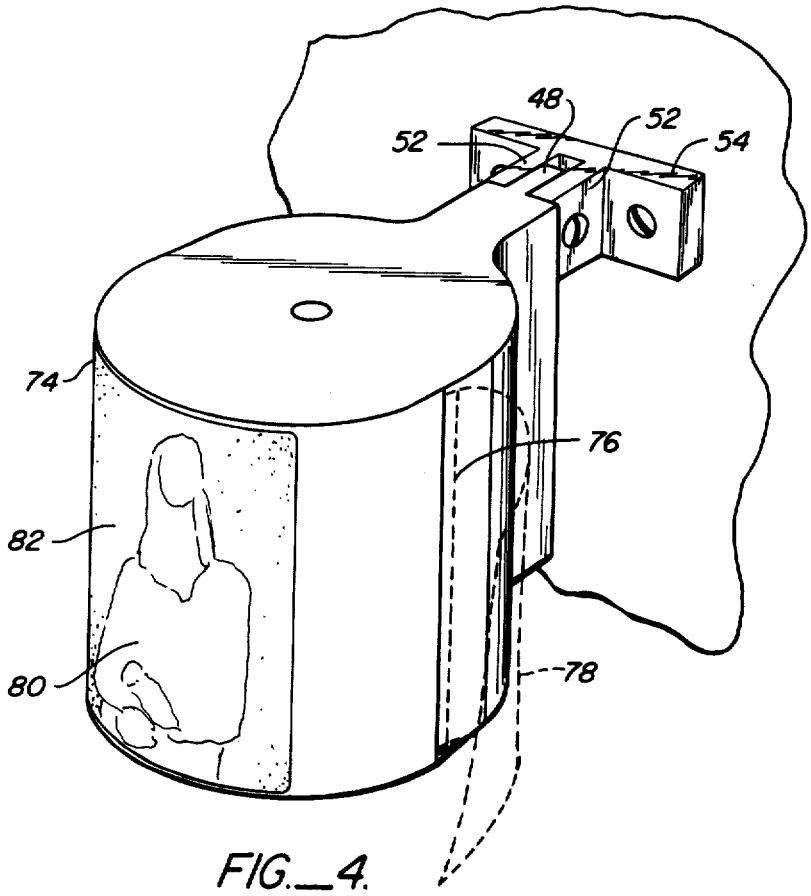
FIG. 4 is a perspective view of the holder of FIG. 2 with a cover removably mounted thereon, the cover having a slot to allow paper from the roll on the holder to exit from the cover.
Figure 5:
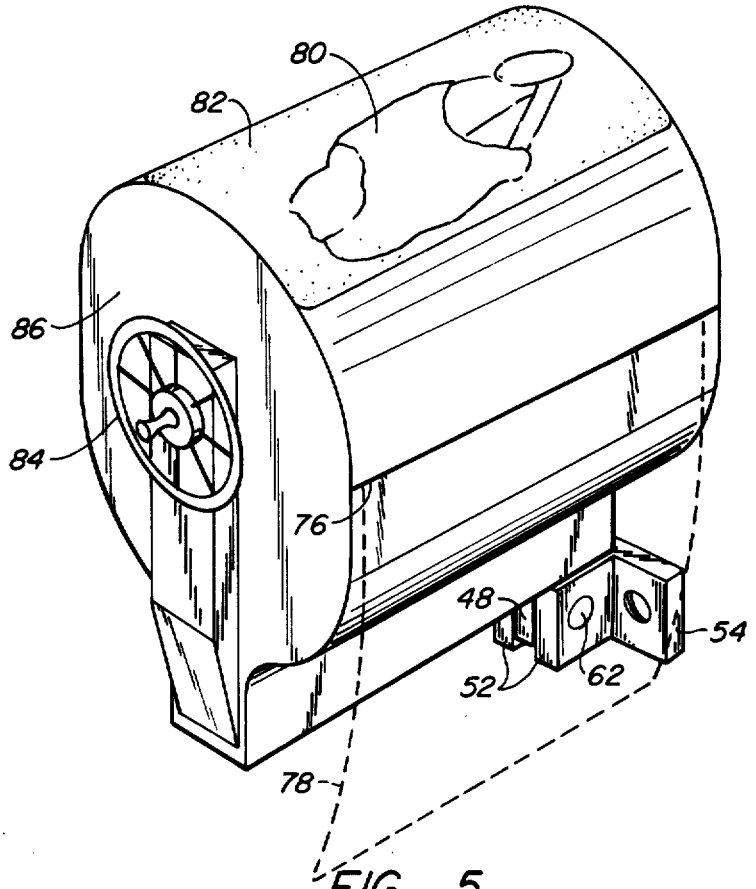
FIG. 5 is a perspective view of the holder of FIGS. 2, 3 and 4 but showing the cover mounted in a position at right angles to the position shown in FIG. 4.

FIGS. 4 and 5 show perspective views of the holder 40 when the holder has a housing or tubular cover 74 removably mounted thereon. The cover has a side slot 76 through which the paper 78 can pass to allow the roll to be unrolled while it is in either of the positions of FIGS. 2 and 3. Cover 74 can be of any suitable construction such as a shell made of two separable pieces. The cover can have artwork 80 on the outer surface 82 thereof and end 80 can have a decorative wheel or other three dimensional decorative object projection on the end face 86 thereof, if desired. This wheel can be used to rotate the roll if spindle 66 is rotatable on leg 46.

Figure 6:
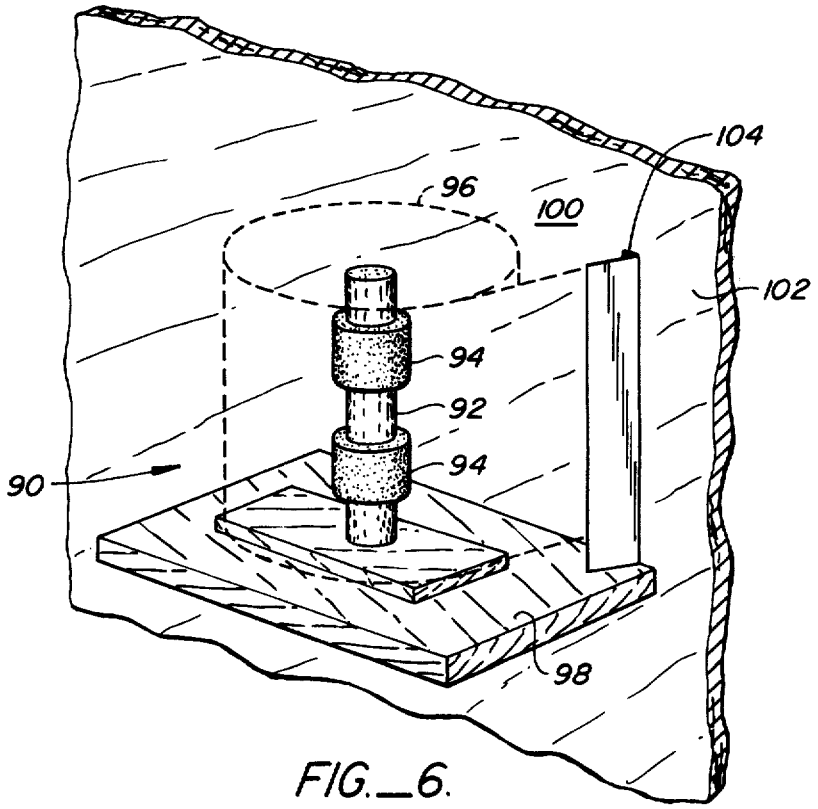
FIG. 6 is a perspective view of a third embodiment of the invention, showing the holder mounted on the inner surface of a swingable door or vertical panel having a slot therethrough for receiving the paper.
Figure 7:
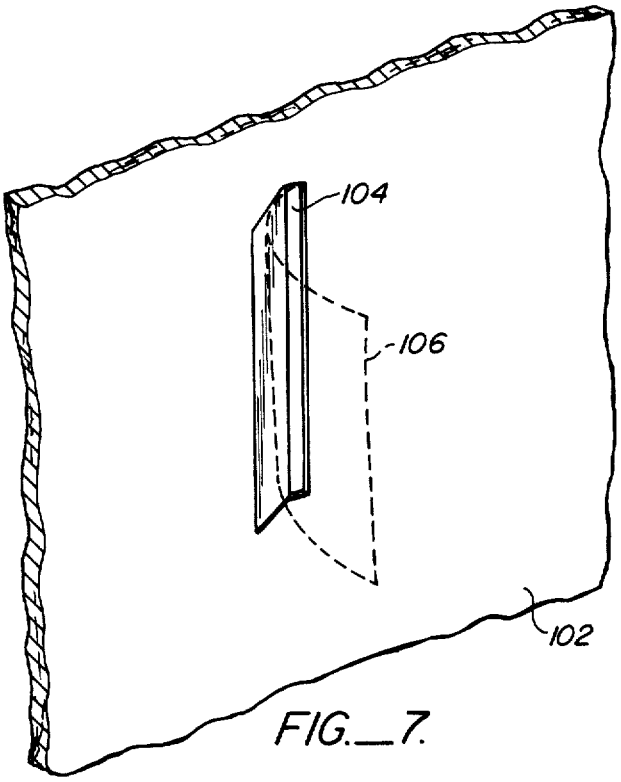
FIG. 7 is a perspective view of the front of the door showing the slot therein and the paper extending outwardly from the slot.

Another embodiment of the holder of the present invention is broadly denoted by the numeral 90 and is shown in FIG. 6. Holder 90 includes a spindle 92 having spaced pieces 94 of resilient material mounted thereon for frictional engagement with the inner surface of the central cardboard tube of a conventional roll 96 of toilet paper. Spindle 92 is mounted on a bracket 98 secured to and extending inwardly from the flat inner surface 100 of a swingable door or vertical panel 102 positioned adjacent to the location at which the toilet paper roll is to be used. Door 102 has a vertical slot 104 therethrough for receiving the toilet paper strip 106 as shown in FIG. 7. Bracket 98 is generally horizontal so that spindle 92 is generally vertical. However, bracket 98 could be vertical and spindle 92 horizontal. In such a case, slot 104 would also be horizontal. The toilet paper roll is placed on and taken off of the spindle in the usual manner and the frictional force between pieces 94 and the inner surface of the cardboard central tube of the toilet paper roll is sufficiently light to allow the roll to rotate relative to pieces 94 to pull paper off the roll, assuming that spindle 92 is rigid to bracket 98. However, the spindle could be rotatably mounted on the bracket.

Figure 8:
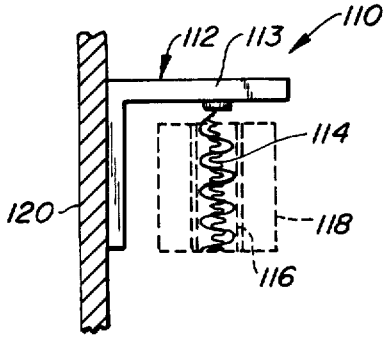
FIG. 8 is a top plan view of another embodiment of the holder, showing a bottle brush forming the spindle of the holder.

Another embodiment of the holder of the present invention is shown in FIG. 8 and denoted by the numeral 110. Holder 110 includes an L-shaped bracket 112 having a spindle 114 made of brush material, such as the material of a bottle brush having bristles which extend outwardly from the longitudinal axis of the brush itself. The bristles are shown as frictionally engaging the inner surface of the central cardboard tube 116 of a conventional roll 118 of toilet paper and the spindle 114 can either be vertical or horizontal. As shown, the spindle is horizontal with bracket 112 secured in any suitable manner to a wall 120 or other vertical support. Bracket 112 could be rotated from the position shown in FIG. 8 to another position 90° from that shown in FIG. 8 so that spindle 114 can be vertical and above leg 113 of bracket 112.

The bottle brush material is resilient to allow some compression of the bristles of the material as the toilet paper roll is placed on the spindle 114. Bristles therefore lightly apply a frictional force to the central cardboard tube 116 of the roll 118 so that roll 118 can rotate on the bottle brush material to unroll the paper therefrom.

Figure 9:
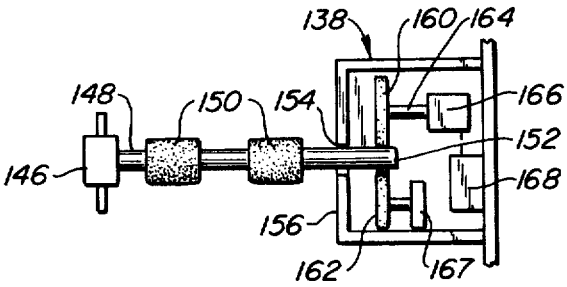
FIG. 9 is a top plan view of a holder for a paper roll in which the holder is motor driven.
Figure 10:
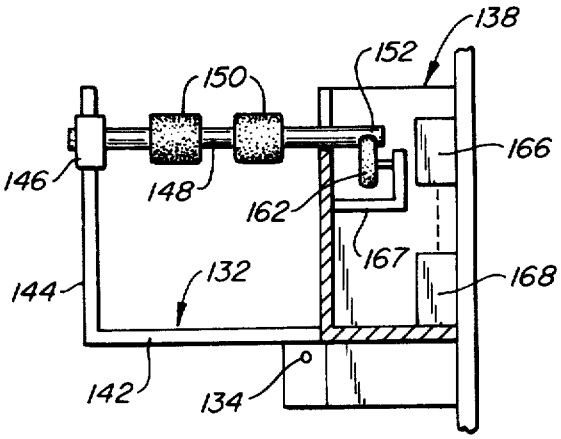
FIG. 10 is a side elevational view, partly in section of the holder of FIG. 9.

Another embodiment of the holder of the present invention is broadly denoted by the numeral 130 and is shown in FIGS. 9 and 10. Holder 130 is motor driven and includes an L-shaped bracket 132 hingedly mounted by a hinge 134 on the front face 136 of a housing 138 adapted to be secured to a vertical wall 140 or the like. Bracket 132 has a generally horizontal leg 142 and a generally vertical leg 144, leg 144 having a bearing 146 for rotatably mounting one end of a spindle 148 having one or more pieces 150 of resilient material, such as plastic sponge, sponge rubber or other resilient material. The spindle is adapted to rotatably mount a roll of toilet paper thereon with pieces 150 in frictional engagement with the inner surface of a central cardboard tube of a conventional roll of toilet paper.

The opposite end 152 of spindle 148 removably extends through a slot 154 in the side wall 156 of housing 138, and end 152 frictionally and simultaneously engages a rubber drive wheel 160 and a rubber idler wheel 162. Wheel 160 is coupled to the drive shaft 164 of an electric motor 166 powered by a battery 168. Idler 162 has a shaft 164 rotatably mounted on a fixed support 167 in housing 138.

Spindle 148 can pivot into and out of the operative position thereof shown in FIG. 10 by rotating bracket 132 about the axis of hinge 134. Slot 154 is large enough to allow end 152 to rotate alternately in a clockwise sense and a counterclockwise sense relative to housing 138. Thus, spindle 148 can move in a counterclockwise sense out of frictional engagement with wheels 160 and 162 and into a vertical position to allow replacement of the toilet paper roll on the spindle. Then, the spindle can be returned to its horizontal position with end 152 frictionally engaging wheels 160 and 162.

Motor 166 can be operated by a switch 170 mounted in any suitable manner on bracket 132, such as on the outer end thereof. Switch 170 can be a push-button switch or can be a microphone switch which renders motor 166 activated by sound.

The present invention therefore provides a holder for a toilet paper roll which is simple and rugged in construction, can take the form of any one of a number of different embodiments, yet it can permits a toilet paper roll to be placed on and taken off the spindle of the holder in a simple and expeditious manner without substantial disassembly of the holder. The materials for making the holder are inexpensive and the holder has a long useful operating life notwithstanding its simplicity of construction.

I claim:

1. A holder for a toilet paper roll having a central cardboard tube comprising: a bracket adapted to be secured in a fixed position and having means thereon at one end thereof for hingedly mounting the bracket on an adjacent support for rotation about a generally horizontal axis; a spindle mounted on the bracket in a cantilever fashion and adapated to removably receive the cardboard tube of a toilet paper roll; and means including a piece of resilient sponge material mounted on the spindle for frictionally engaging the inner surface of the cardboard tube of the roll.

2. A holder as set forth in claim 1, wherein said spindle is rigidly secured to the bracket.

3. A holder as set forth in claim 1, wherein the spindle is rotatably mounted on the bracket.

4. A holder as set forth in claim 1, wherein said spindle has a longitudinal slot extending therethrough, said resilient material extending through said slot and projecting laterally from the spindle.

5. A holder as set forth in claim 4, wherein said bracket has a rigid extension projecting laterally therefrom, said spindle being secured to the outer end of the extension and projecting laterally therefrom.

6. A holder as set forth in claim 1, wherein said bracket is L-shaped to present a first leg having said hinge means at one end thereof and a second leg secured to and extending laterally from the outer end of the first leg, said spindle being mounted on the outer end of the second leg and extending laterally outwardly therefrom substantially parallel with the first leg.

7. A holder as set forth in claim 6, wherein the spindle is rigidly secured to the second leg.

8. A holder as set forth in claim 6, wherein said spindle is rotatably mounted on the second leg.

9. A holder as set forth in claim 6, wherein is included a housing removably mounted on the bracket, said housing having a slot for receiving the paper therethrough from a roll mounted on the spindle.

10. A holder as set forth in claim 1, wherein is included a motor, means mounting the motor adjacent to the bracket, said motor having drive means coupled therewith, said spindle being rotatably mounted on the bracket and having an end engagable with said drive means, whereby the spindle will be rotated as the motor is actuated.

11. A holder as set forth in claim 10, wherein is included a switch mounted on the bracket for actuating the motor.

12. A holder as set forth in claim 10, wherein said switch is a push-button switch.

13. A holder as set forth in claim 10, wherein said switch is a microphone switch.

14. A holder as set forth in claim 10, wherein the bracket is hingedly mounted on the motor mounting means.

* * * * *